US005325910A

United States Patent [19]

Schneider et al.

[11] Patent Number: 5,325,910

[45] Date of Patent: Jul. 5, 1994

[54] METHOD AND APPARATUS FOR CONTINUOUS CASTING

[75] Inventors: Wolfgang Schneider, St. Augustin; Kurt Krämer, Bonn, both of Fed. Rep. of Germany

[73] Assignee: Vereinigte Aluminium-Werke Aktiengesellschaft, Bonn, Fed. Rep. of Germany

[21] Appl. No.: 83,381

[22] Filed: Jun. 28, 1993

[30] Foreign Application Priority Data

Sept. 20, 1985 [DE] Fed. Rep. Germany ..... 3533517.3

Related U.S. Application Data

[63] Continuation of Ser. No. 779,126, Oct. 16, 1991, abandoned, which is a continuation of Ser. No. 660,223, Feb. 20, 1991, abandoned, which is a continuation of Ser. No. 512,051, Apr. 12, 1990, abandoned, which is a continuation of Ser. No. 399,390, Aug. 28, 1989, abandoned, which is a continuation of Ser. No. 294,945, Jan. 3, 1989, abandoned, which is a continuation of Ser. No. 183,405, Apr. 12, 1988, abandoned, which is a continuation of Ser. No. 909,827, Apr. 19, 1986, abandoned.

[51] Int. Cl.[5] ..... B22D 11/04; B22D 11/07

[52] U.S. Cl. ..... 164/472; 164/487; 164/268; 164/444

[58] Field of Search ..... 164/487, 472, 268, 444, 164/425, 426, 445, 446

[56] References Cited

U.S. PATENT DOCUMENTS

| | | | |
|---|---|---|---|
| 3,667,534 | 6/1972 | Kanokogi et al. | 164/426 X |
| 3,795,270 | 3/1974 | Fiala et al. | 164/425 X |
| 4,157,728 | 6/1979 | Mitamura et al. | 164/487 X |

FOREIGN PATENT DOCUMENTS

| | | | |
|---|---|---|---|
| 14137/83 | 5/1984 | Australia . | |
| 1814658 | 7/1969 | Fed. Rep. of Germany . | |
| 57-50250 | 3/1982 | Japan | 164/472 |
| 1110553 | 4/1968 | United Kingdom | 164/268 |
| 1143475 | 2/1969 | United Kingdom . | |
| 2129344A | 5/1984 | United Kingdom . | |

OTHER PUBLICATIONS

"Proceedings Of Third International Aluminum Extrusion Technology Seminar", Vol. II-Billet & Extrusion Process & Equipment, Automation, Safety & Environment, Apr. 24-26, 1984, Atlanta, Ga., cover page and pp. 247-256.

*Primary Examiner*—Kuang Y. Lin
*Attorney, Agent, or Firm*—Darby & Darby

[57] ABSTRACT

Disclosed is a method for continuous casting with a continuous casting annular mold. The method includes: providing a continuous annular casting mold having a superstructure secured over a chill, the superstructure including an overhang extending over the inner wall of the chill; cooling the inner wall surface of the chill; introducing a mixture of a lubricant and gas under pressure at the transition of the overhang and the inner wall surface of the chill. The mixture is introduced in a direction parallel to the inner wall surface of the chill. A molten material to be cast is introduced to the mold in a direction from above the superstructure. The cast material is drawn off from below the chill, and the mixture of gas and lubricant maintains a gap between the material to be cast and the inner wall surface of the chill. A continuous casting mold is also disclosed.

25 Claims, 5 Drawing Sheets 6a
6
2
3
4
13
8
9
5
7
4a
1

METHOD AND APPARATUS FOR CONTINUOUS CASTING

This is a continuation of application Ser. No. 07/779,126, filed Oct. 16, 1991 which is a continuation of application Ser. No. 07/660,223, filed Feb. 20, 1991 which is a continuation of application Ser. No. 07/512,051, filed Apr. 12, 1990 which is a continuation of application Ser. No. 07/399,390, filed Aug. 28, 1989 which is a continuation of application Ser. No. 07/294,945, filed Jan. 3, 1989 which is a continuation of application Ser. No. 07/183,405, filed Apr. 12, 1988 which is a continuation of application Ser. No. 06/909,827, filed Sep. 19, 1986, all now abandoned.

FIELD OF THE INVENTION

The present invention relates to continuous casting. More particularly, the invention relates to continuous casting with a chill.

BACKGROUND OF THE INVENTION

In continuous casting processes molten metal is poured at a steady rate into a cooled mold. Typically, a shell forms by solidification of the metal along the mold wall. The casting is withdrawn from the bottom of the mold. The solidified shell acts to contain the molten metal inside the shell. The casting emerging from the bottom of the mold is sprayed to cool and solidify the metal further.

A chill can be used to increase the rate of cooling of the casting. A chill is typically a metal or graphite insert placed in a mold to rapidly cool and solidify the casting, producing a hard surface.

One type of continuous casting mold including a chill has an upper superstructure positioned above the chill. The inner wall (facing the molten metal) of the superstructure projects closer to the molten metal than the inner wall of the chill to form an overhang over the chill where the chill meets the superstructure. In use, the inner wall of the chill is cooled and lubricated, and a gas under pressure is introduced to the mold cavity at the point where the superstructure meets the chill.

The method and apparatus described above is disclosed in DE-OS 27 34 388, to Showa, published Feb. 2, 1978. The method described in the Showa reference leads to fairly smooth billet surfaces only under favorable conditions. When starting to cast, for example, monitoring and regulating the pressure of the gas and lubricating oil flow is necessary. In addition, continuous temperature measurements must be made to adjust the casting parameters. In practice, the need for continuous monitoring and adjustment often leads to difficulties in producing satisfactory castings. These problems are compounded by fluctuations of the metal level and changes of the metallostatic pressure in the running casting process.

Further, it has been found that with the method according to DE-OS 27 34 388 lead-containing alloys containing up to 2.5% lead cannot be cast satisfactorily. These alloys are of special importance in the manufacture of continuous casting products to be machined by chipping.

Experiments with gaseous lubricants like acetylene, butadiene, propane and trichlorethylene have shown that, under the pressure and temperature conditions prevailing in the chill, it is not possible to obtain suitable lubrication making use of the decomposition of the gaseous lubricants. When conventional lubricants without gas are used, by introduction parallel to the chill axis, lubricant combustion will occur in the starting phase, (meniscus cavity) and subsequent underdosing of lubricant will occur along the running surface of the chill. It is therefore, not possible to establish optimal lubrication by lubricant dosing only.

OBJECTS OF THE INVENTION

It is an object of the present invention to avoid the disadvantages of the process described above, and to develop a method and an apparatus for continuous casting whereby smooth and neat billet surfaces can be obtained independently of the respective casting conditions. The high surface quality entails the prevention of tacky or sticking areas and reduction of surface liquation. A casting with a high surface quality is advantageous because further processing is possible without having to turn the ingot on a lathe to remove tacky or sticking areas and surface liquations.

SUMMARY OF THE INVENTION

In the method according to the present invention, it has been unexpectedly discovered that it is important that the chill running surface (below the overhang) be absolutely smooth and free of holes, steps or grooves, which are sometimes present to allow the introduction of lubricant. The smooth surface is needed to allow a laminar flow to be established and maintained. It is particularly important at the start of casting, to maintain a laminar flow parallel to the chill running surface so that the inflowing metal does not make contact with the chill wall. If the inflowing metal does make contact with the chill wall, liquation and tacky areas will occur. The laminar flow effect is intensified during the starting phase such that a minimum distance of 2 to 5 mm is provided between starter block and chill running surface, and in that an underpressure is generated in this interspace between the chill and the casting, preferably by the effect of the coolant jet blown out at the chill discharge end (water jet pumping effect). The starter block is a special section of casting that is provided within the mold before any molten metal is introduced. The 2–5 mm distance is provided by using a starting block having a slightly smaller diameter than the chill.

BRIEF DESCRIPTION OF THE DRAWINGS

Other features and advantages of the present invention can be more fully understood from the following detailed description with reference to the accompanying drawings in which.

DETAILED DESCRIPTION OF THE PREFERRED EMBODIMENTS

Figure 1:
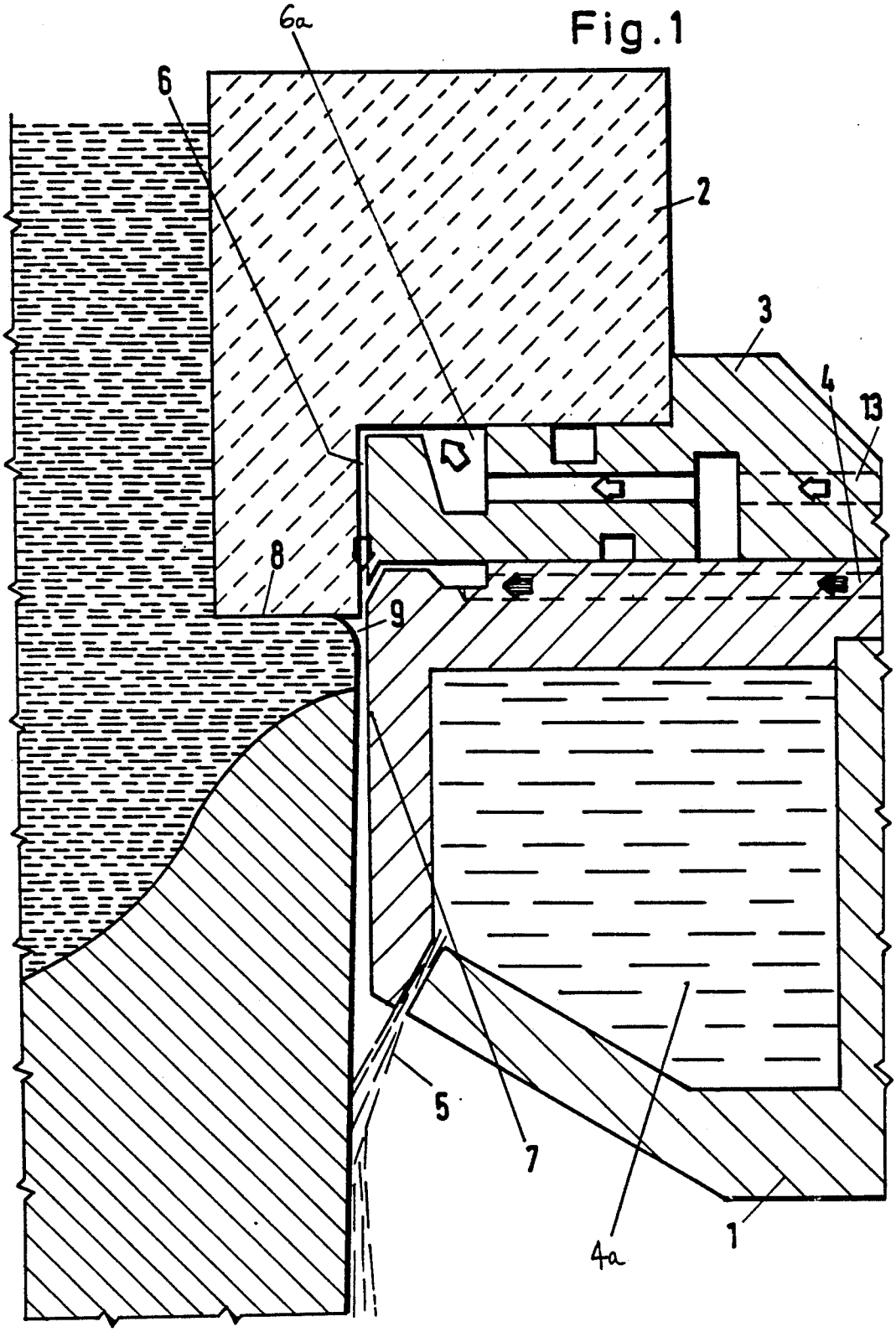
FIG. 1 is a longitudinal section view of a first embodiment of the present invention.

In a first embodiment of the invention illustrated in FIG. 1, reference numeral 1 represents a chill, taken through a transverse section. The casting mold of the invention is generally of circular shape, for example, if a cylindrical casting is desired. A transverse section taken at any point along the perimeter would be the same, with the exception of the provision for a gas channel and a lubricant channel. Mold superstructure 2 is positioned above chill 1. The superstructure 2, includes a hot head 2 made of refractory material (such as calcium silicate) and a gas conduction block 3. The gas conduction block 3 can be made of aluminum or steel. A gas channel 13 runs through gas conduction block 3. Hot head 2 and gas conduction block 3 are sealed to each other by gaskets and screws (not shown).

Chill 1 can be made of aluminum or copper. Chill 1 contains a bore 4 for supplying separating agent and/or lubricant. A channel 5 is provided in chill 1 for the water cooling system. Channel 5 is a water outlet. The water inlet is not shown. The water in the reservoir serves to both cool the chill, and cool the casting by spraying from channel 5. Chill 1 and gas conduction block 3 are secured to each other such that the inner faces of both chill 1 and gas conduction block 3 are substantially parallel.

The inner face of chill 1 constitutes running surface 7. Hot head 2 is shaped so that when mounted to gas conduction block 3 the inner wall (facing the molten metal) of hot head projects closer to the molten metal of the casting than the running surface of the chill, to form an overhang 8 over the chill where the chill meets superstructure. The outer face of overhang is separated from the inner surface of gas conduction block 3 to form an annular gap 6. Since the inner surface of gas conduction block 3 is substantially parallel to running surface 7 of chill 1, annular gap 6 is substantially parallel to running surface 7. Gas channel 13 communicates with the upper end of annular gap 6 at the upper end of the outer surface of overhang 8. Gas ring **6*a* provides a uniform and homogeneous gas supply to the annular gap 6. Bore 4 intersects annular gap 6 at an acute angle at the lower end of the outer surface of overhang 8. Bore 4 intersects gap 6 at an acute angle allow the separating agent and/or lubricant to readily mix with the gas flowing through gap 6**. A preferred length of annular gap is 10–30 millimeters.

It is important that running surface 7 and the surface of the chill in the vicinity of the outlet of annular gap 6 be free from offsets, bores or grooves. A smooth surface is important to permit an approximately laminar flow of the mixture of separating agent and/or lubricant and gas.

During the casting process, molten metal is introduced to the continuous casting mold from above. The molten metal forms a meniscus where the lower outer edge of overhang 8 meets chill 1 at a right angle. This is the same point where annular gap 6 meets running surface 7.

In operation, gas is injected through the annular channel 6 to the meniscus cavity 9. Various types of gases which can be used include, but are not limited to: air, nitrogen, argon, $CO_2$, and freon. The force of the gas traveling through gap 6 causes the parts of the liquid separating agent or lubricant, e.g. oil, to entrain with the gas. An aerosol or emulsion of gas and lubricant/separating agent forms and travels in laminar flow below the overhang 8 in the draw-off direction (the direction of the flowing cast metal) and parallel to the chill running surface 7.

As the cast metal flows downwardly, the molten metal starts to solidify. Along the edge of the chill 1, the cast metal is at least partially solidified. At the beginning of a casting run the solid metal first presented along the chill is called the starter block. The gas/lubricant emulsion travels along the gap present between the starter block and running surface 7. Channel 5 located at a lower edge of chill 1 is directed towards the starter block and a water jet is forced through channel 5 towards the block. The direction of flow of the water jet causes the formation of a vacuum, drawing the gas/lubricant emulsion downwardly along running surface 7 and the edge of the starter block. The vacuum causes the formation of an annular gas/oil veil, which completely shields the chill wall 7 from the liquid metal, present above the starter block. The starter block is seen in FIG. 1 to include a peripheral raised edge at its upper end.

The provision of an annular gap in the direction of the running surface of the chill and the premixing of separating and/or lubricating agents with the gas makes it unnecessary to readjust the casting parameters after they have been initially set for the run. In particular, the volume of gas and lubricant, do not have to be readjusted once set initially, even at fluctuating molten metal level about the superstructure.

The method according to the invention is applied preferably to alloy groups susceptible to cracking, although other alloys and metals can be successfully used with the present invention. Aluminum alloys as well as alloys of lead, copper, zinc and other metals can be used in continuous casting with the apparatus and method of the present invention.

EXAMPLE 1

In the following, an example is given for continuous castings having a diameter of 10 inches, where the ratio (by volume of separating agent to gas) of separating agent (rape seed oil) to gas air was 3:1000:

| | |
|---|---|
| $AlM_g5$ | Casting rate 70 mm per minute |
| $AlCuM^g{}_2$ | Casting rate 65 mm per minute |
| $AlAnM_gCul.5$ | Casting rate 65 mm per minute |
| $AlCuM_gPb$ | Casting rate 65 mm per minute |

It was possible to keep these casting rates constant immediately after startup. No other casting parameters had to be readjusted. The flow rates for gas, lubricant, and cooling water were kept constant. The water jet strikes the casting at a rate of approximately 6 $m^3$/hour. The billet surfaces obtained showed a high surface quality.

Figure 2:
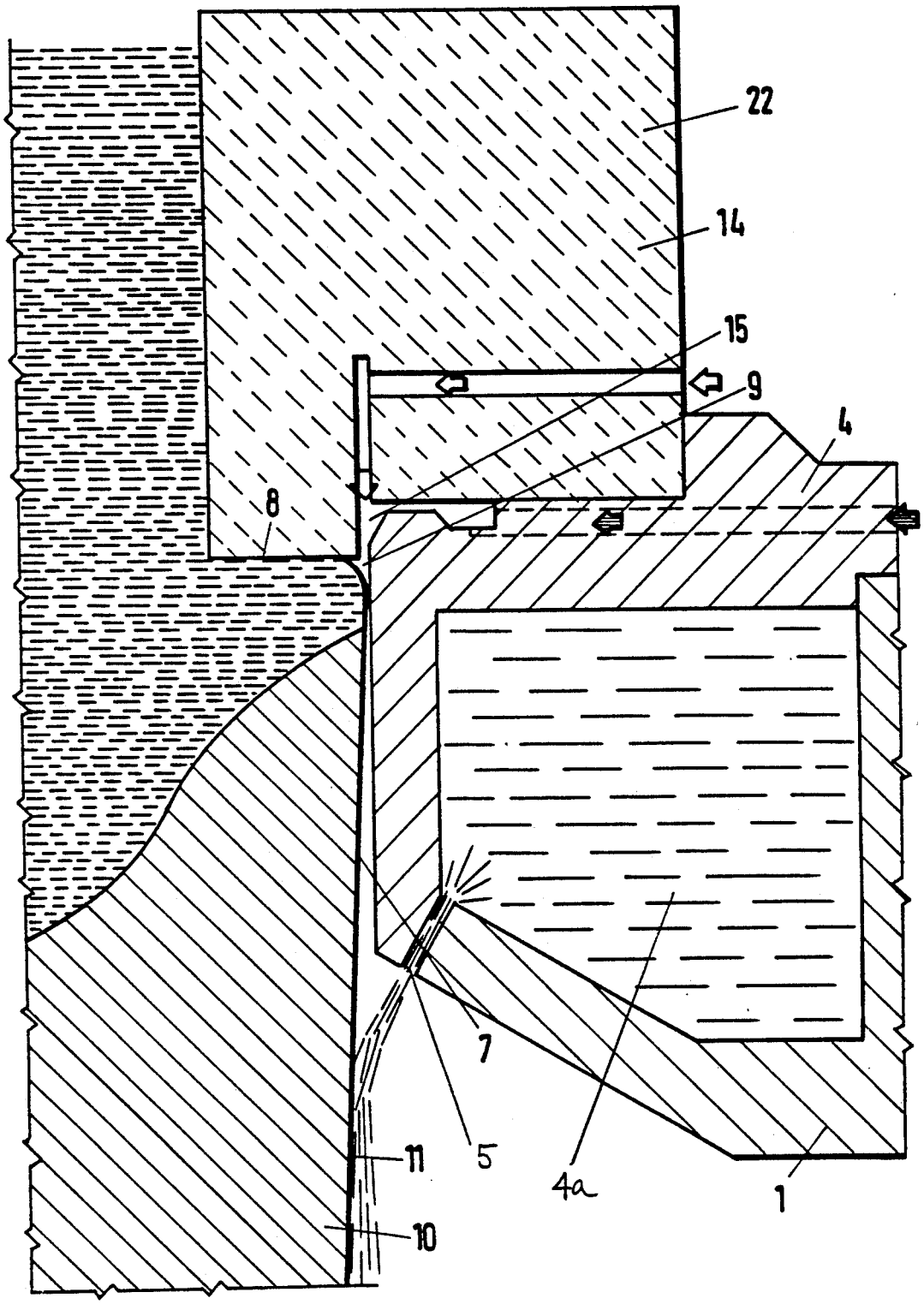
FIG. 2 is a longitudinal section view of a second embodiment of the present invention.

FIGS. 2 to 5 show additional embodiments of the present invention. Referring to FIG. 2, there is shown a superstructure 22 made in one part, rather than in the two parts shown in the superstructure of FIG. 1. The bore for the gas channel 14 runs through superstructure 22 and discharges into a wide antechamber 15 between overhang 8 and running surface 7. Oil is fed towards antechamber 15 through bore 4 in chill 1. At antechamber 15 the mixture of the separating agent and/or lubricant with gas takes place. For cooling the billet 10, water 11 is ejected from reservoir **4*a* through channel 5**.

Figure 3:
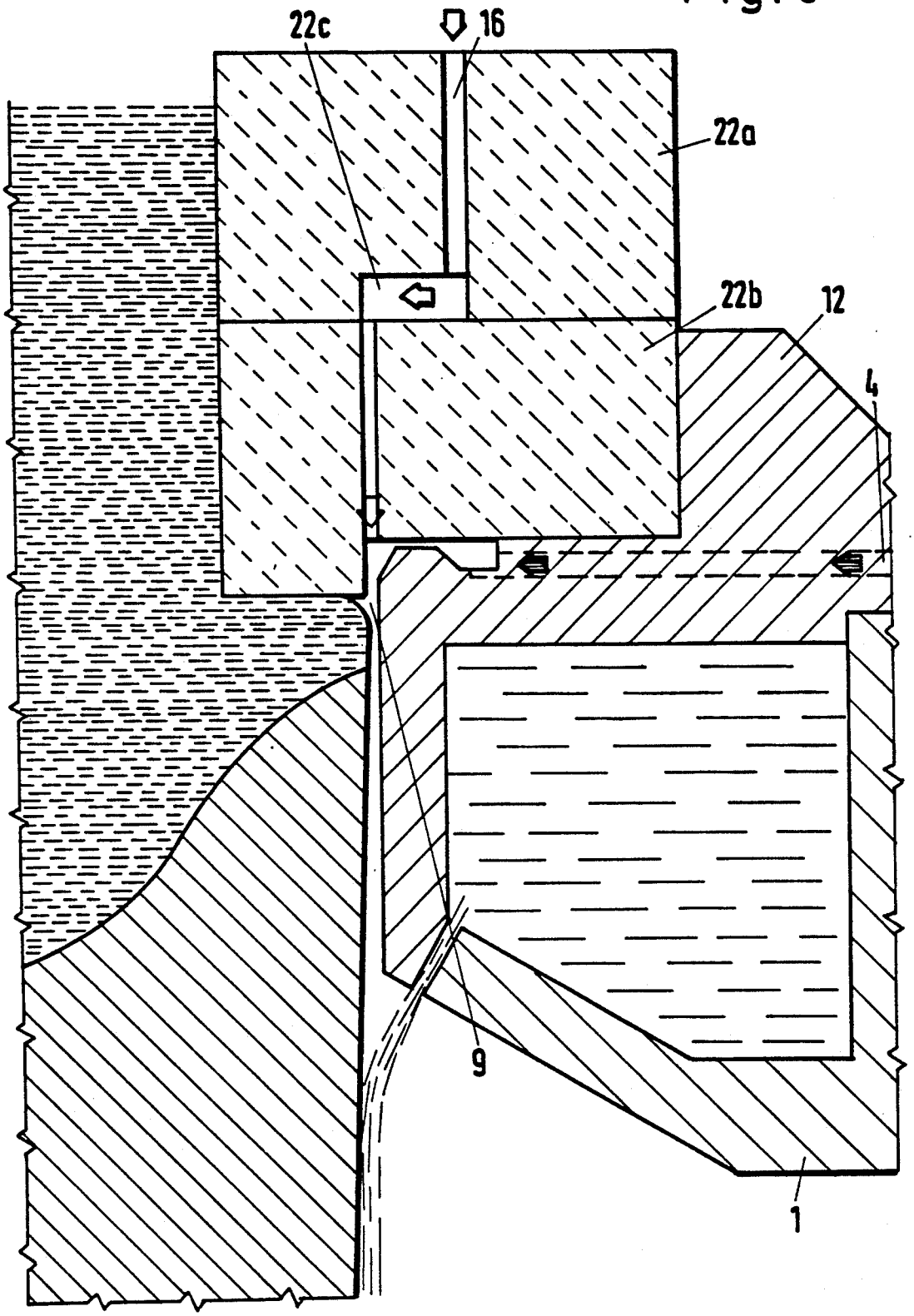
FIG. 3 is a longitudinal section view of a third embodiment of the present invention.

Another embodiment of the apparatus according to the invention is shown in FIG. 3. Here the superstructure is divided horizontally into two segments **22*a* and 22*b*. Gas line 16 extends in draw-off direction from upper part 22*a* and is interrupted only by a chamber 22*c* for gas distribution. Gas chamber 22*c* extends around the perimeter of the mold as a ring and helps to maintain a homogeneous gas flow. Chill 1 has a supporting wall 12 for secure positioning of the superstructure 22***a* and 22*b* against the chill. The other components of the continuous casting mold, such as lubricant bore 4 and antechamber 15, correspond to the design shown in FIG. 2. This embodiment is advantageous because a metallic gas conduction block is not needed.

Figure 4:
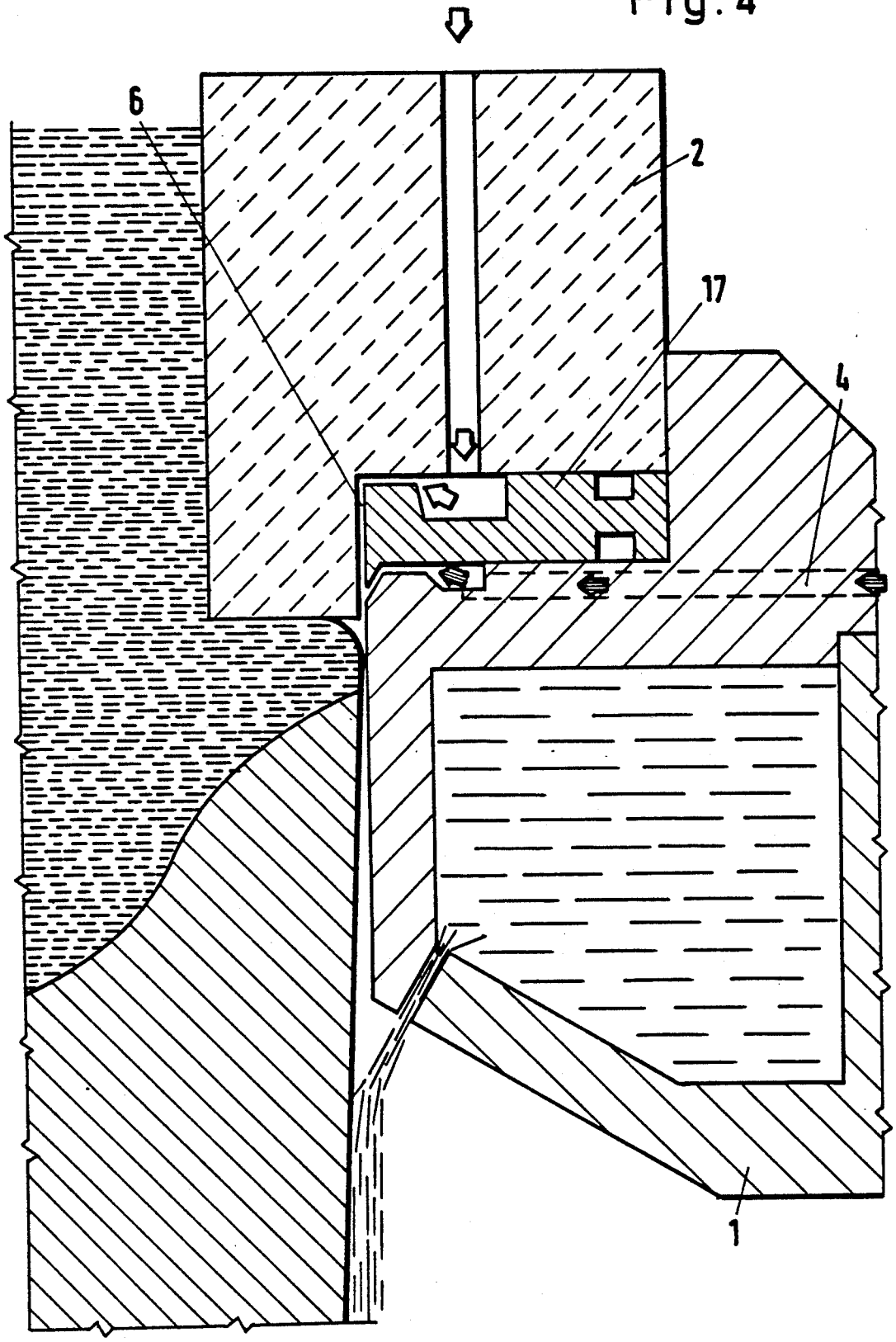
FIG. 4 is a longitudinal section view of a fourth embodiment of the present invention.

In FIG. 4, a differently shaped gas conduction block in the form of an insert 17 is provided between the chill 1 and the hothead 2. The insert is made of metal and allows a more precise fitting of parts and close tolerances of bores, chambers and grooves are obtained. The close tolerances are especially important for use in making heavier castings, e.g. castings over 10 inches in diameter. In addition, gas line 16 is bored straight through hothead 2 into the gas distribution chamber of insert 17.

Figure 5:
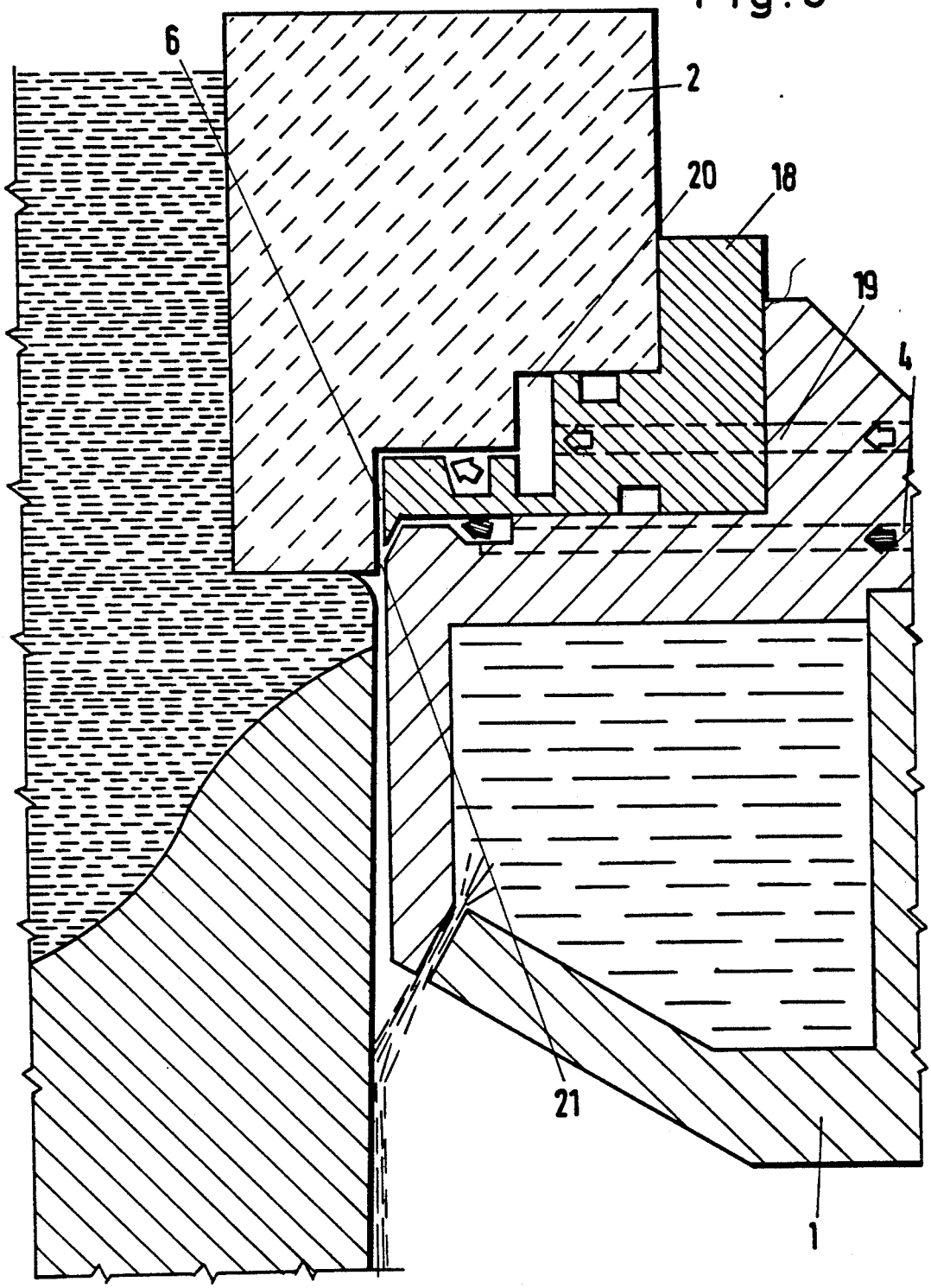
FIG. 5 is a longitudinal section view of a fifth embodiment of the present invention.

In FIG. 5, an insert 18 is arranged between the chill 1 and the hot head 2. In contrast to FIG. 4, in FIG. 5 gas line 19 extends horizontally through chill 1 and the insert part 18 into an antechamber 20, from which the gas flows into annular gap 6. There is a seal between chill 1 and insert 18 to prevent the gas line 19 from leaking. The seal is preferably made of rubber. The mixing of the gas with the lubricant and/or separating agent, which is supplied via bore 4, occurs variably between 2 and 10 mm before (the) outlet opening of annular gap 6. The actual point of mixing is dependent on the type of insert that is used. The ability to predetermine the point of mixing allows the mixing process to be optimized. Different oils having different viscosities exhibit different mixing behavior with various gases. All other features correspond to the parts described in connection with the preceding figures.

In numerous tests using the apparatus and method of the present invention, it has been found that the gas/oil mixture need not be regulated by variation of pump pressure or volume, even if the metal level within the mold fluctuates. Evidently, the combined action of the gas/oil veil and suction effect along the running surface is so strong that even upon variation of the metallostatic pressure, a buffer action persists between the metal and the running surface.

What is claimed is:

1. A method for continuous casting with a continuous casting annular mold, comprising:

providing a continuous annular casting mold having a superstructure secured over a chill, the chill having an inner wall with an inner wall surface which extends away from the superstructure, the superstructure including an overhand spaced from the inner wall of the chill, cooling the inner wall surface of the chill, directing a gas to flow under pressure parallel to the inner wall surface of the chill toward an area of transition of the overhang and the inner wall surface of the chill, directing a lubricant to mix with the flow of gas upstream of the transition so as to provide a mixture of the lubricant and gas under pressure in which the mixture flows in a direction parallel to the inner wall surface of the chill toward the transition, introducing at the transition of the overhang and the inner all surface of the chill the mixture of the lubricant and gas under pressure, the mixture being introduced in a direction parallel to the inner wall surface of the chill, drawing off cast material from below the chill, and maintaining a gap between the material to be cast and the inner wall surface of the chill by flowing the mixture through the gap so as to avoid lubricant combustion, subsequent underdosing of the lubricant along the inner wall surface of the chill, and liquation and tacky area formation of the material being cast, and the molten material remaining spaced apart from the inner wall surface during passage of the molten material through the mold.

2. The method of claim 1 wherein said mixture of lubricant and gas is formed in a ratio by volume of between about 1:1000 and 4:1000.

3. The method of claim 1 wherein said mixture comprises a separating agent and gas.

4. The method of claim 1 further comprising providing a starter block in said mold before the introduction of said material to be cast.

5. The method of claim 4 wherein said starter block has a perimeter less than the perimeter of said inner wall surface of said chill.

6. The method of claim 1 further comprising providing a vacuum between said inner wall surface of said chill and said material to be cast and/or said starter block.

7. The method of claim 6 wherein said vacuum is created by providing a liquid cooling stream against the surface of the material to be cast and below said inner wall surface of the chill.

8. The method of claim 1 wherein the material to be cast forms a meniscus at the transition of said overhand and said inner wall surface of said chill.

9. A method for continuous casting with a continuous casting annular mold, comprising the steps of:

cooling an inner wall surface of a chill, the inner wall surface extending away from a superstructure of a continuous annular casting mold;

directing a gas to flow under pressure parallel to the inner wall surface of the chill toward an area of transition of the overhang and the inner wall surface of the chill;

directing a lubricant to mix with the flow of gas upstream of the transition so as to provide a mixture of the lubricant and gas under pressure in which the mixture flows in a direction parallel to the inner wall surface of the chill toward the transition;

introducing at the transition of the overhang of the superstructure and the inner wall surface of the chill the mixture of the lubricant and gas under pressure;

directing the mixture to flow before the mixture reaches the transition in a direction which is parallel to the inner wall surface of the chill and thereafter through a gap between the inner wall surface and a molten material to be cast;

introducing the molten material to be cast adjacent to the overhang; and keeping the molten material from touching the inner wall surface during passage of the molten material through the mold by flowing the mixture through the gap so as to avoid lubricant combustion, subsequent underdosing of the lubricant along the inner wall surface of the chill, and liquation and tacky area formation of the molten material being cast, whereby the molten material remains spaced apart from the inner wall surface.

10. The method of claim 9, wherein the step of introducing at a transition includes suctioning the mixture to flow through said gap.

11. The method of claim 9, wherein the flow is laminar.

12. A continuous casting annular mold, comprising:

an annular superstructure;

an annular chill secured below the superstructure, the chill having a smooth inner all surface which extends away from the superstructure, the superstructure including an overhang, the chill including means for cooling the inner wall surface;

a gas supply line for supplying gas to flow in a direction parallel to the inner wall surface of the chill before reaching a juncture of the overhang and the inner wall surface of the chill;

a lubricant supply line for supplying lubricant to the gas supply line upstream of the juncture so that a mixture of the lubricant and the gas emerges to flow from the gas supply line in a direction parallel to the inner wall surface of the chill; and means for maintaining a gap between the inner wall surface and a molten material which is beneath the overhang by flowing the mixture through the gap so as to avoid lubricant combustion, subsequent underdosing of the lubricant along the inner wall surface of the chill, and liquation and tacky area formation of the molten material being cast, whereby the mixture flows through the gap and the molten material remains spaced apart from the inner wall surface during passage of the molten material through the mold.

13. The continuous casting mold of claim 2 wherein said gas supply line terminates at an annular gap within said supersturcture, said annular gap disposed parallel to said inner wall surface of said chill, and terminating at the transition of said overhang and said inner wall surface of said chill.

14. The continuous casting mold of claim 13 wherein said lubricant supply line terminates at said annular gap at a point downstream of the termination point of said gas supply line.

15. The continuous casting mold of claim 13 wherein said annular gap is about 10–30 millimeters in length.

16. The continuous casting mold of claim 11 wherein said lubricant supply line terminates about 2–10 millimeters above said transition of said overhang and said inner wall surface of said chill.

17. The continuous casting mold of claim 12 wherein said cooling means includes a cooling reservoir within said chill.

18. The continuous casting mold of claim 12 further comprising a gas conduction block mounted between said chill and said superstructure.

19. The continuous casting mold of claim 18 wherein said gas supply line passes through said gas conduction block.

20. The continuous casting mold of claim 12 further comprising a gas ring along the path of said gas supply line.

21. The continuous casting mold of claim 12 further comprising a starter block surrounded by said annular chill, said starter block having a perimeter such that there is a gap of about 2 to 5 millimeters between the starter block surface and said inner wall surface of said chill.

22. The continuous casting mold of claim 21 wherein said starter block includes a peripheral raised edge at its upper end.

23. A continuous casting annular mold, comprising:

means for cooling an inner wall surface of a chill, the inner wall surface extending away from a superstructure of a continuous annular casting mold;

means for directing a gas to flow under pressure parallel to the inner wall surface of the chill toward an area of transition of the overhang and the inner wall surface of the chill;

means for directing a lubricant to mix with the flow of gas upstream of the transition so as to provide a mixture of the lubricant and gas under pressure in which the mixture flows in a direction parallel to the inner wall surface of the chill toward the transition;

means for introducing at the transition of the overhang of the superstructure and the inner wall surface of the chill the mixture of the lubricant and gas under pressure;

means for directing the mixture to flow before the mixture reaches the transition in a direction which is parallel to the inner wall surface of the chill and thereafter through a gap between the inner wall surface and a molten material to be cast;

means for introducing the molten material to be cast adjacent to the overhang; and means for keeping the molten material from touching the inner wall surface during passage of the molten material through the mold by flowing the mixture through the gap so as to avoid lubricant combustion, subsequent underdosing of the lubricant along the inner wall surface of the chill, and liquation and tacky area formation of the molten material being cast, whereby the molten material remains spaced apart from the inner wall surface.

24. A continuous casting mold of claim 23, wherein said introducing a mixture means includes a gas supply line and a lubricant supply line which communicate with each other upstream of the transition relative to the direction of flow of the mixture to the transition.

25. A continuous casting mold of claim 23, wherein said means for introducing a mixture includes suctioning the mixture through the gap.

* * * * *